US006255615B1

(12) United States Patent
Kimblin

(10) Patent No.: US 6,255,615 B1
(45) Date of Patent: Jul. 3, 2001

(54) MULTIPLE CONTACT SWITCH

(76) Inventor: Clive William Kimblin, 225 Tech Rd., Pittsburgh, PA (US) 15205

( * ) Notice: Subject to any disclaimer, the term of this patent is extended or adjusted under 35 U.S.C. 154(b) by 0 days.

(21) Appl. No.: 09/476,836

(22) Filed: Jan. 3, 2000

(51) Int. Cl.[7] ..... H01H 9/32
(52) U.S. Cl. ..... 218/155; 335/17
(58) Field of Search ..... 218/155, 123–127, 218/118, 146, 125; 335/17

(56) References Cited

U.S. PATENT DOCUMENTS 4,743,876 * 5/1988 Milianowicz et al. ..... 335/20
5,095,293 * 3/1992 Patel et al. ..... 335/17

* cited by examiner

*Primary Examiner*—Michael L. Gellner
*Assistant Examiner*—Nhung Nguyen

(57) ABSTRACT

A vacuum switch having a fixed stationary and moveable contact that functions very much like a conventional vacuum circuit interrupter. In addition, an annular stationary contact is positioned on the opposite side of the moveable contact from the first mentioned stationary contact with the drive rod of the moveable contact slidable within the annular opening of the additional stationary contact. The moveable contact travels between three positions. The first position is in electrical communication with the first mentioned stationary contact, the second position is an intermediate position that opens the circuit, and the third position places the moveable contact in electrical communication with the annular stationary contact. Preferably, one of the stationary contacts is grounded and the moveable contact is connected to the load, so that the switch either connects the power line to the load, opens the circuit in the intermediate position, or grounds the load to facilitate maintenance.

18 Claims, 2 Drawing Sheets

MULTIPLE CONTACT SWITCH

This patent application is related to corresponding U.S. Patent applications Ser. No. 09/476,243, Ser. No. 09/476,564, and Ser. No. 09/476,501 all filed concurrently herewith.

BACKGROUND OF THE INVENTION

1. Field of the Invention

This invention pertains in general to switches that employ contacts maintained in hermetically sealed housings that contain a medium having a higher dielectric strength than air and more particularly to such switches that employ a single drive rod to move the contacts relative to each other.

2. Background of the Invention

Circuit breakers provide protection for electrical systems from electrical fault conditions such as current overloads, short circuits, and low level voltage conditions. Typically, circuit breakers include a spring powered operating mechanism which opens electrical contacts to interrupt the current through the conductors on an electrical system in response to abnormal conditions. In particular, vacuum circuit interrupter apparatus has been known which includes separable main contacts disposed within an insulating housing. Generally, one of the contacts is fixed relative to both the housing and to an external electrical conductor which is interconnected with the circuit to be controlled by the circuit interrupter. The other contact is moveable. In the case of a vacuum circuit interrupter, the moveable contact assembly usually comprises a stem of circular cross section having the contact at one end enclosed within the vacuum chamber and a driving mechanism at the other end which is external to the vacuum chamber. An operating rod assembly is provided which carries a rotatable contact bell crank which is slidable on the operating rod and rotates about a pivot pin upon motion of the operating rod. This plate is connected to the stem or drive rod of the moveable contact. Motion of the plate causes motion of the moveable contact into or out of engagement with the fixed contact.

The operating rod assembly is operably connected to a latchable operating mechanism which is responsive to current. When an abnormal condition is reached, the latchable operating mechanism becomes unlatched which causes the operating rod to move to the open position. The motion of the operating rod, in turn, causes the contact or crank to rotate and, as discussed above, this controls motion of the moveable contact. The operation of this type of vacuum interrupter is more fully described in U.S. Pat. No. 5,095,293, issued Mar. 10, 1992 to the assignee of the present invention.

Vacuum interrupters or reclosers are typically used, for instance, to reliably interrupt medium to high voltage AC currents of several thousands of amperes or more. Reclosers are interrupters that are designed to automatically reclose after a given delay and for a given number of times in an attempt to automatically re-establish the circuit. However, from the standpoint of this invention, the principles discussed herein apply equally well to both.

Typically, in accordance with the prior art practices, one vacuum interrupter is provided for each phase of a multiphase circuit and the interrupters for the several phases are actuated simultaneously by a common latchable operating mechanism. This does not permit point-on-wave switching among the multiple phases and can give rise to arcing and uneven contact wear. Co-pending patent application, Ser. No. 09/476,243 (Attorney Docket No. 97-PDC-524), filed concurrently herewith and assigned to the assignee of this invention, addresses this problem by supplying independent means for actuating the vacuum interrupters respectively associated with each phase of the circuit.

In general, the prior art had actuated the circuit interrupters to the open condition before servicing. While that action opens the circuit it does not drain the circuit of residual charge that can, under certain circumstances, create a safety issue. The aforecited co-pending application recognizes the desirability of providing a mechanism for grounding the circuit before maintenance takes place. Accordingly, an optimum design for achieving that objective is desired.

SUMMARY OF THE INVENTION

These and other needs are satisfied by the present invention which comprises a circuit switch design that in the broader sense includes two contacts; one stationary and one moveable. The stationary contact has an annular opening through which a drive rod, which is attached to a moveable contact, extends. The drive rod reciprocates the moveable contact between at least two positions; one in contact with the annular stationary contact and the other in the open position where the moveable contact is spaced from the annular stationary contact. Typically, the contacts are sealed in a vacuum vessel and the drive rod is mounted to slidably and sealably extend through the vacuum vessel where it is connected to an actuation mechanism. The seal typically employed to maintain an effective barrier while enabling drive rod motion is a bellows seal.

In the preferred embodiment a fixed stationary contact is provided on the side opposite the moveable contact in juxtaposition to the annular stationary contact. In this configuration, the drive rod reciprocates the moveable contact between three positions. The first position situates the moveable contact in electrical communication with the fixed stationary contact; the second position places the moveable contact between the fixed and annular stationary contacts establishing an open circuit condition; and the third position is where the moveable contact is moved into electrical communication with the stationary contact having the annular opening.

A further enhancement includes placing a raised annular contacting surface on the side of the moveable contact opposing the stationary contact having the annular opening. Preferably the inside diameter of the raised surface on the moveable contact is larger than the diameter of the annular opening in the stationary contact. Another enhancement places insulation on the corners of the annular opening of the first stationary contact. In addition, the drive rod of the moveable contact can be insulated, e.g., covered with a ceramic. Desirably, the size of the annular opening in the stationary contact is large enough to prevent arcing with or without the assistance of the foregoing insulation.

In this preferred embodiment either one of the stationary contacts is connected to ground and the other stationary contact is connected to line. The moveable contact is connected to the load. In this way, a load can be conveniently connected to its electrical power source, disconnected or grounded to facilitate maintenance.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENTS

Figure 1:
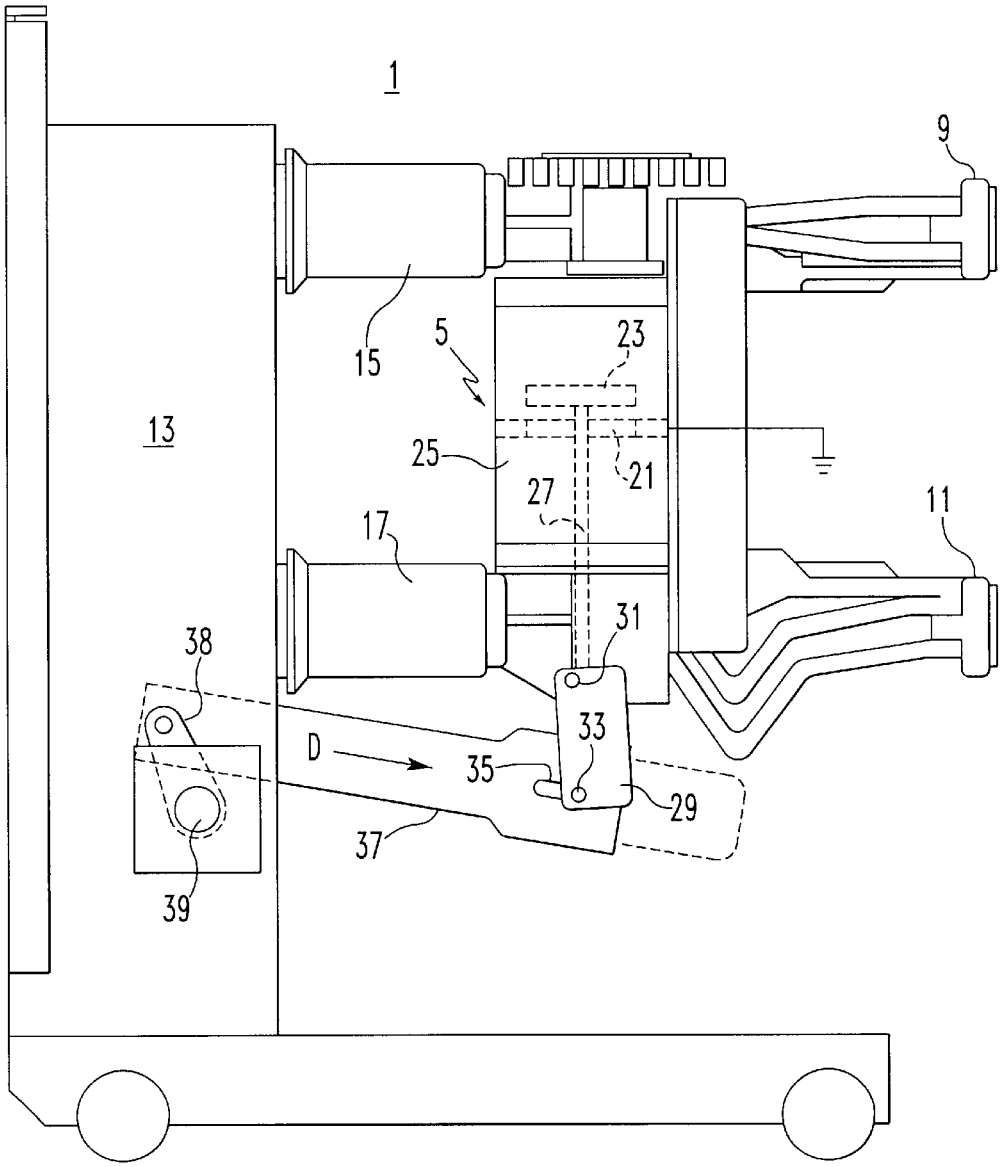
FIG. 1 is a schematic side elevation of a circuit breaker having a two position switch in the form of a vacuum interrupter assembly constructed in accordance with this invention.

Referring to FIG. 1, there is illustrated a circuit breaker 1 incorporating a vacuum interrupter apparatus 5 constructed in accordance with this invention. The circuit breaker 1 is one of several designs that can be employed with this invention and is preferably a draw-out three phase vacuum circuit interrupter which has controls on the front panel 7 for manually operating the circuit breaker. The circuit breaker 1 also has terminals 9 and 11 for one phase of the breaker and it has additional terminals not visible in FIG. 1 which correspond to the other two phases in a three-phase circuit. The terminals, 9 and 11, are for contacting corresponding terminals in an associated system (not shown).

The circuit breaker 1 has a front low voltage portion 13 adjacent to the front panel 7 and a rear high voltage portion including the vacuum circuit interrupter 5. The high and low voltage portions are electrically insulated from one another by upper and lower insulators 15 and 17, respectively. Alternatively, the vacuum interrupter of this invention can be provided in the modular arrangement described in the aforecited co-pending application. Vacuum interrupter 5, shown in FIG. 1, encloses a pair of separable contacts, including stationary contact 21 and moveable contact 23 within a vacuum housing 25, which is comparable to a conventional circuit interrupter, except that the stationary contact 21 has an annular opening through which the drive stem of the moveable contact 23 extends within the vacuum housing 25.

An operating mechanism that can be used to move the contacts 21 and 23 between an open and closed position is described in detail in U.S. Pat. No. 4,743,876, which is owned by the assignee of the present application. U.S. Pat. No. 4,743,876 is herein incorporated by reference in its entirety. Briefly, vacuum interrupter moving stem 27 is suitably connected to a rotatable contact bell crank 29. Contact bell crank 29 is pivotally mounted at upper pin 31. It is also rotatably mounted at lower pin 33. Pin 33 is slidably fastened in slot 35 of the operating rod 37.

Operating rod 37 moves in response to the rotation of lever arm 38 about operating shaft 39. This motion occurs when a latchable operating mechanism (not shown in FIG. 1), discussed more fully in the above-cited U.S. Pat. No. 4,743,876, is activated in response to an abnormal condition. When the operating rod 37 is moved to open the contact, operating rod 37 moves generally horizontally in the direction "D". Pin 33 slides in slot 35 also in a generally horizontal direction. Bell crank 29 rotates in an arc-shaped path and the vertical component of this arc-shaped motion acts to lift vacuum interrupter moving stem 27 which moves moveable contact 23 until it unseats from the fixed contact 21. In accordance with this invention, the stationary contact 21 is supported from the side walls of the vacuum chamber 25 and includes an annular opening in its center through which the drive stem 27 of the moveable contact 23 extends. In the open condition, the stem 27 is forced by the bell crank 29 through the stationary contact 21 to separate the moveable contact 23 from electrical communication with the stationary contact 21. In the closed condition, the moveable stem 27 is driven outwardly by the bell crank 29 as the operating rod moves in a direction opposite to "D", to force the moveable contact 23 into engagement with the stationary contact 21. Typically, the moveable contact is connected to the load and the stationary contact is connected to the line.

Figure 2:
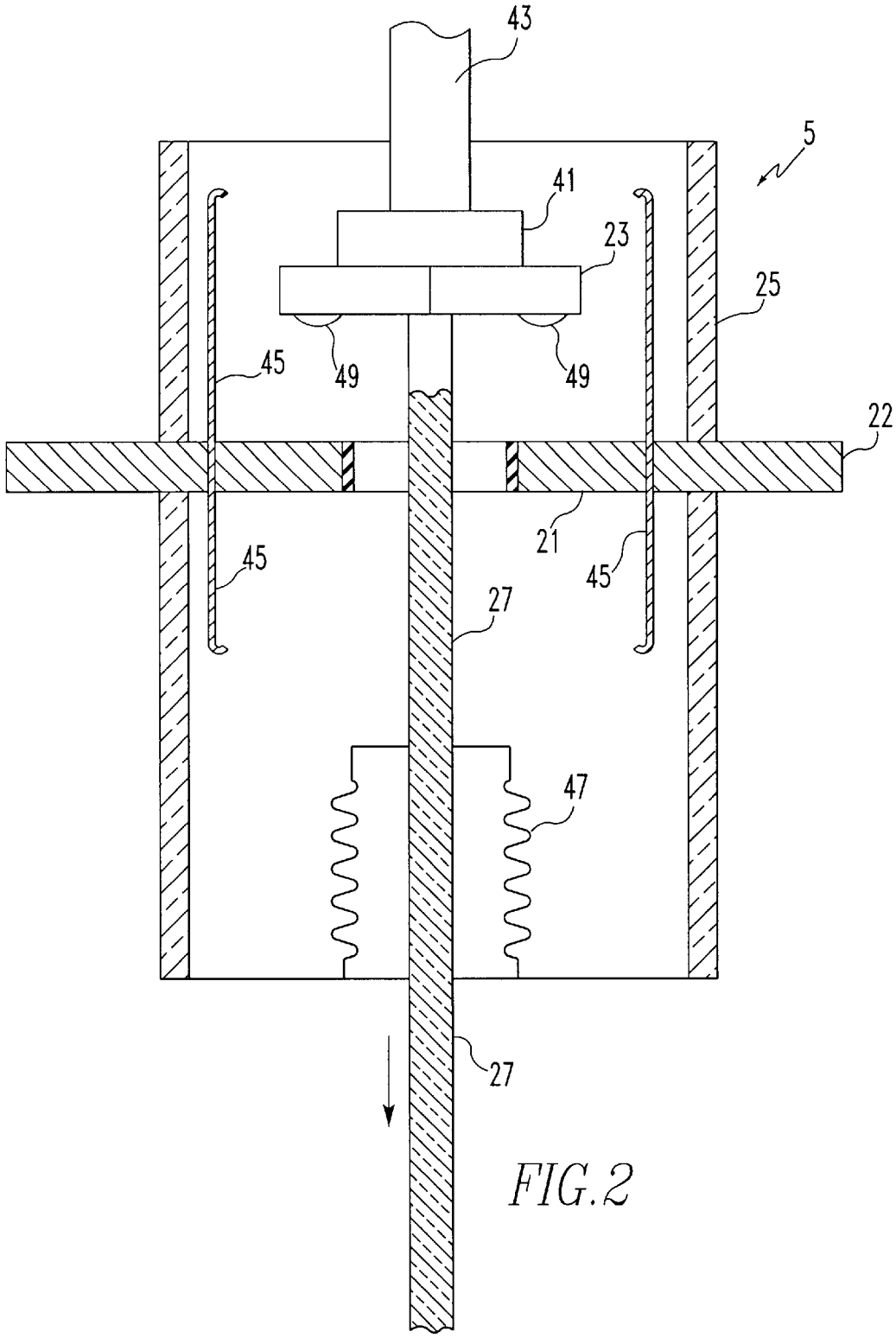
FIG. 2 is a schematic sectional drawing showing the interior contact arrangement of this invention in a three position switch configuration.

FIG. 2 illustrates the second embodiment of the switch of this invention employing three separate contacts. The embodiment illustrated in FIG. 2 is shown in more detail than that illustrated in FIG. 1 and employs the same design except for an additional stationary contact 41 which is connected to the exterior of the housing 25 by the terminal 43 which can, for example, be connected to the line or power source. The electrical path through the moveable contact 23 extends through the drive stem 27 and can, for example, be connected to a load. The circular stationary electrode 21 is shown as extending through the wall of the housing 25 and can, for example, be connected to ground through an electrical conductor/connector 22. It is also possible to support the circular contact from the wall of the housing 25 and have an electrical conductor extend through the wall to the ground connection.

The moveable electrode 23 is driven by the stem 27 through the three positions. The three positions can be established by a manual rotary switch or a three position over the center toggle, which is not shown, but which is well known in the art. The first position would place the moveable contact in electrical communication with the additional stationary contact 41; connecting the line to the load. The second position of the moveable contact is an intermediate position between the stationary contacts 21 and 41, opening the load circuit. The third position places the moveable contact in electrical communication with the stationary contact 21, grounding the circuit to facilitate, for example, maintenance of the load. The housing 25 can be constructed out of any electrical insulating material capable of maintaining the hermetic seal and vacuum environment. It should be appreciated that the housing can employ insulating medium other than a vacuum, e.g., $SF_6$ without departing from the spirit of this invention.

To enhance electrical communication between the moveable contact 23 and the stationary contact 21, the moveable contact includes a raised contact surface 49, which can, for example, be an annular ring, whose inside diameter is preferably greater than the inside diameter of the annular opening of the stationary contact 21. This will facilitate seating of the juxtaposed surfaces of the moveable contact 23 and the stationary contact 21.

In this example, the drive stem 27 of the moveable contact 23 is shown connected to a bellows seal 47 to facilitate movement of the drive stem while maintaining the sealed environment. It should be recognized that other slidable seals can also be employed for this purpose. For high voltage applications it is preferable to cover the drive stem 27 of the moving contact 23 with a ceramic for added insulation. It should be appreciated that the surface of the stem 27 will be largely "shaded" from vapor deposition by the large surface of the moving contact. As a further enhancement, the edges of the annular opening of the stationary contact 21 can be covered with insulation to avoid arcing. In addition, the housing insulation is enhanced with the use of a vapor condensation shield 45.

It should be appreciated that the functions of the stationary contacts 41 and 21 can be reversed and additional stationary contact 41 can be connected to ground. It should also be appreciated that with an appropriate latchable operating mechanism like the three position over center toggle previously mentioned, the switch can be employed as a vacuum circuit interrupter. Thus, an improved three position vacuum switch is provided that enables grounding of the load to facilitate, for example, safe maintenance procedures. It should also be appreciated that the switch of this invention can be employed as the vacuum isolator switch module described in co-pending application Ser. No. 09/476,243 (Attorney Docket No. 97-PDC-524) which was filed concurrently herewith.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention which is to be given the full breadth of the appended claims and any and all equivalents thereof.

What is claimed is:

1. A three position circuit switch comprising:

a sealed container housing a medium having a higher dielectric strength than air, wherein the container is impermeable to the medium;

a first stationary contact sealed within the container;

a first electrical conductor connected to the first stationary contact at one end, sealably penetrating the container and terminating at the other end in a first electrical connector;

a moveable contact sealed within the container and moveable along an axis of movement between a first position, out of electrical communication with the first stationary contact, and a second position, in electrical communication with the stationary contact;

an additional stationary contact positioned on the opposite side of the moveable contact from the first stationary contact, wherein the additional stationary contact at least in part surrounds the axis of movement of the moveable contact and the moveable contact is moveable to a third position in electrical contact with the additional stationary contact;

a second electrical conductor connected to the additional stationary contact at one end, sealably penetrating the container and terminating at the other end in a second electrical connector;

a drive stem connected to the moveable contact at one end, extending through the additional stationary contact and sealably and movably extending through the container, the drive stem forming a third electrical conductor terminating outside the container in a third electrical connector; and a drive mechanism positioned outside of the container for moving the drive stem along a linear path between the first, second and third positions in response to an actuation command indicative of a given circuit condition, or upon operator command.

2. The circuit switch of claim 1 wherein the additional stationary contact has a hollow center opening through which the drive stem extends.

3. The circuit switch of claim 2 wherein the moveable contact has a larger width than the opening in the additional stationary contact.

4. The circuit switch of claim 3 wherein the clearance between the opening in the additional stationary contact and the drive stem is sufficient to prevent arcing.

5. The circuit switch of claim 1 wherein the moveable contact has a circular circumferential design.

6. The circuit switch of claim 2 wherein the edges of the hollow section of the additional stationary contact are insulated.

7. The circuit switch of claim 1 comprising a circuit interrupter.

8. The switch of claim 1 wherein the second electrical connector is connected to ground.

9. The circuit switch of claim 1 wherein the first electrical connector is connectable to a power source.

10. The circuit switch of claim 1 wherein the drive stem is covered with electrical insulation.

11. The circuit switch of claim 10 wherein the insulation is a ceramic.

12. The circuit switch of claim 1 including a vapor condensation shield within the container.

13. The circuit switch of claim 1 wherein the second electrical conductor is formed from a portion of the additional stationary contact that sealably penetrates the container housing.

14. The circuit switch of claim 1 wherein the medium is a vacuum.

15. The circuit switch of claim 2 wherein the moveable contact has a raised portion on the contact side that abuts the additional stationary contact.

16. The circuit switch of claim 15 wherein the raised portion is annular.

17. The circuit switch of claim 16 wherein the raised annular portion has a larger diameter than the diameter in the hollow opening of the additional stationary contact.

18. A circuit switch comprising:

a sealed container housing a medium having a higher dielectric strength than air, wherein the container is impermeable to the medium;

a stationary contact having an annular opening substantially centered and sealed within the container;

a first electrical conductor connected to the stationary contact at one end, sealably penetrating the container and terminating at the other end in a first electrical connector;

a moveable contact sealed within the container and moveable between a first position, out of electrical communication with the stationary contact, and a second position, in electrical communication with the stationary contact;

a drive stem connected to the moveable contact at one end, extending through the stationary contact and sealably and movably extending through the container, the drive stem forming a second electrical conductor terminating outside the container in a second electrical connector; and a drive mechanism positioned outside of the container for moving the drive stem along a linear path between the first and second positions in response to an actuation command indicative of a given circuit condition, or upon operator command.

* * * * *